US006309232B1

(12) United States Patent
Okabe et al.

(10) Patent No.: US 6,309,232 B1
(45) Date of Patent: Oct. 30, 2001

(54) LEVER-ACTUATED CONNECTOR

(75) Inventors: Toshiaki Okabe; Tetsuya Yamashita, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/639,955

(22) Filed: Aug. 17, 2000

(30) Foreign Application Priority Data

Aug. 20, 1999 (JP) ..... 11-234700

(51) Int. Cl.[7] ..... H01R 13/62
(52) U.S. Cl. ..... 439/157; 439/372
(58) Field of Search ..... 439/157, 372

(56) References Cited

U.S. PATENT DOCUMENTS

| | | | | |
|---|---|---|---|---|
| 3,801,757 | | 4/1974 | Carissimi et al. | 200/50.28 |
| 4,582,378 | * | 4/1986 | Fruchard | 439/157 |
| 5,711,682 | | 1/1998 | Maejima | 439/157 |
| 6,019,620 | | 2/2000 | Kodama et al. | 439/157 |

FOREIGN PATENT DOCUMENTS 06325821 11/1994 (JP) .

11-26070 1/1999 (JP) .

* cited by examiner

*Primary Examiner*—Brian Sircus
*Assistant Examiner*—Michael C. Zarroli
(74) *Attorney, Agent, or Firm*—Finnegan, Henderson, Farabow, Garrett & Dunner, L.L.P.

(57) ABSTRACT

A substantially parallelepiped engaging protrusion (30) formed on a side wall (24A) of a lever (24) pivoted on a boss (27) of a connector (21) has an upper front edge part tapered to provide a corner part (30B) defined by a pair of neighboring surfaces (30A, 30C) intersecting with an obtuse angle, the corner part (30B) making contact with a lower corner (37B) of an inclined engagement step (37) formed in a front side of an insertion groove (36) in an inner wall of a hood (34) of a mating connector (22), the inclined engagement step (37) having an inclined surface (37A) at an angle of inclination of at least 45 degrees with respect to a mating direction between the connectors (21, 22), and an upper edge (37C) of the inclined surface (37A) and a lower edge (30B) of a tapered surface (30A) of the engaging protrusion (30) are spaced from each other at a distance (D) in the mating direction so that, even with dimensional errors, there is achieved an ensured operative engagement between the engaging protrusion (30) and the engagement step (37).

6 Claims, 5 Drawing Sheets

PRIOR ART

PRIOR ART

LEVER-ACTUATED CONNECTOR

BACKGROUND OF THE INVENTION

1. Field of the Invention

The present invention relates to a lever-actuated connector, and more particularly to an electric connector of the lever-actuated type in which a terminal-accommodating connector housing (hereafter sometimes simply called "connector") is mated with another terminal-accommodating connector housing (hereafter sometimes called "mating connector") by operation of a lever pivoted thereon.

2. Related Art

FIG. 5 shows such a lever-actuated connector. This lever-actuated connector has a male connector (housing) 1, a lever 2 rotatably mounted to the male connector 1, and a female connector (housing) 3 to be mated with the male connector 1.

The male connector 1 has terminal accommodation chambers 4 provided therethrough in an insertion direction relative to the female connector 3, for accommodation of female terminals (not shown). A pair of ribs 6 laterally protrude at front edges of both side surfaces 5 of the male connector 1, with an even height to the side surfaces 5. A pair of bosses 7 protrude from the side surfaces 5 each to serve as a pivot for the lever 2 to be rotatable thereabout.

The lever 2 is made up by a pair of left and right flat arms 8, and an operation part 9 as a shoulder interconnecting both arms 8 at their rear ends. The bosses 7 are inserted into central parts of the arms 8. At front ends of the arms 8, there are integrally formed protruding parts 10 to be loose-engaged in slots 6a of the ribs 6, whereby the arms 8 are kept from laterally opening. The arms 8 of the lever 2 are formed with lateral protrusions 11 in their front parts, each for engagement with a step 14B in the female connector 3. When the operation part 9 is pressed down, the lever arms 8 rotate counterclockwise about the bosses 7, together with the protrusions 11 pushing up the steps 14B at both sides, causing the female connector 3 to mate on the male connector 1, with the arms 8 inserted therebetween.

The female connector 3 is provided with a hood 12, which is shown in FIG. 5. The hood 12 is open at the top, and matable on combination of the male connector 1 and the lever 2. To accommodate the combination, the hood 12 has therein, along both side walls thereof, a pair of straight grooves 13 formed at front ends of the side walls for guiding the ribs 6 of the male connector 1, and a pair of stepped grooves 14A provided in front halves of the side walls to accept or receive the protrusions 11 of the lever arms 2 to be movable in unison with rotation of the lever 2. Each stepped groove 14A provides the step 14B as a rectangular overhung to be engaged with an upper edge of the protrusion 11 as in FIG. 7.

For the mating, the male connector 1 is inserted into the hood 12 to a depth, where the protrusions 11 of the lever arms 8 face groove regions under the steps 14B. As the lever 2 is pressed to rotate, the protrusions 11 engage with the steps 14B. As the lever 2 is additionally pressed, each engaging protrusion 11 pushes the hood 12 upwardly, contacting therewith at a point. In other words, the lever arms 8 push the male connector 1 downwardly, apparently swinging about the contact points, which then serve as fulcrums.

The lever-actuated connector has a significant number of terminals. The male connector 1 as well as the hood 12 becomes long and narrow, with increase in number of associated electric wires, accompanying reduced dimensional accuracy.

The steps 14B and engaging protrusions 11 are frontwardly offset. As the engaging protrusions hare slid within the stepped grooves 14A, the male connector 1 is subjected to sliding resistance and binding, and tends to tilt relative to the hood 12, as shown in FIG. 6. With the tilting, the protrusions 11 may fail to catch on the steps 14B which are perpendicular to the mating direction and have a smaller depth than wall thickness of the hood 12. As the lever 2 is rotated, failed engagement causes either protrusion 11 to invade between the walls of the hood 12 and lever arm 8, resulting in an improper or incomplete mating.

SUMMARY OF THE INVENTION

The present invention has been made with such points in view. It therefore is an object of the present invention to provide a lever-actuated connector that enables an ensured engagement between an engaging protrusion of a lever and a groove wall to be engaged therewith to push a mating connector in a mating direction.

An aspect of the present invention to achieve the object is a lever-actuated connector comprising a combination of a first connector housing formed with a first protrusion, and a lever member pivoted on the first protrusion and formed with a second protrusion, and a second connector housing configured to be pushed in a mating direction to mate on the combination by rotation of the lever member about the first protrusion, the second connector housing being formed with a reception groove to receive the second protrusion to allow insertion of the combination into the second connector housing, the reception groove having a wall part to be engaged with the second protrusion by the rotation of the lever member to push the second connector housing in the mating direction, the wall part being inclined relative to the mating direction.

According to this aspect of the invention, as a wall part to be engaged with a second protrusion by rotation of the lever member is inclined relative to the mating direction, the second protrusion is safely caught by the wall part which has an increased projection area in a tangential direction of the rotation of lever member.

BRIEF DESCRIPTIONS OF THE DRAWINGS

The above-noted and other features of the present invention will be apparent from the description of embodiments to follow, taking in combination with the accompanying drawings, in which.

DETAILED DESCRIPTION OF THE PREFERRED EMBODIMENTS

Embodiments of a lever-actuated connector according to the present invention are described in detail below, with references being made to relevant accompanying drawings.

Figure 1:
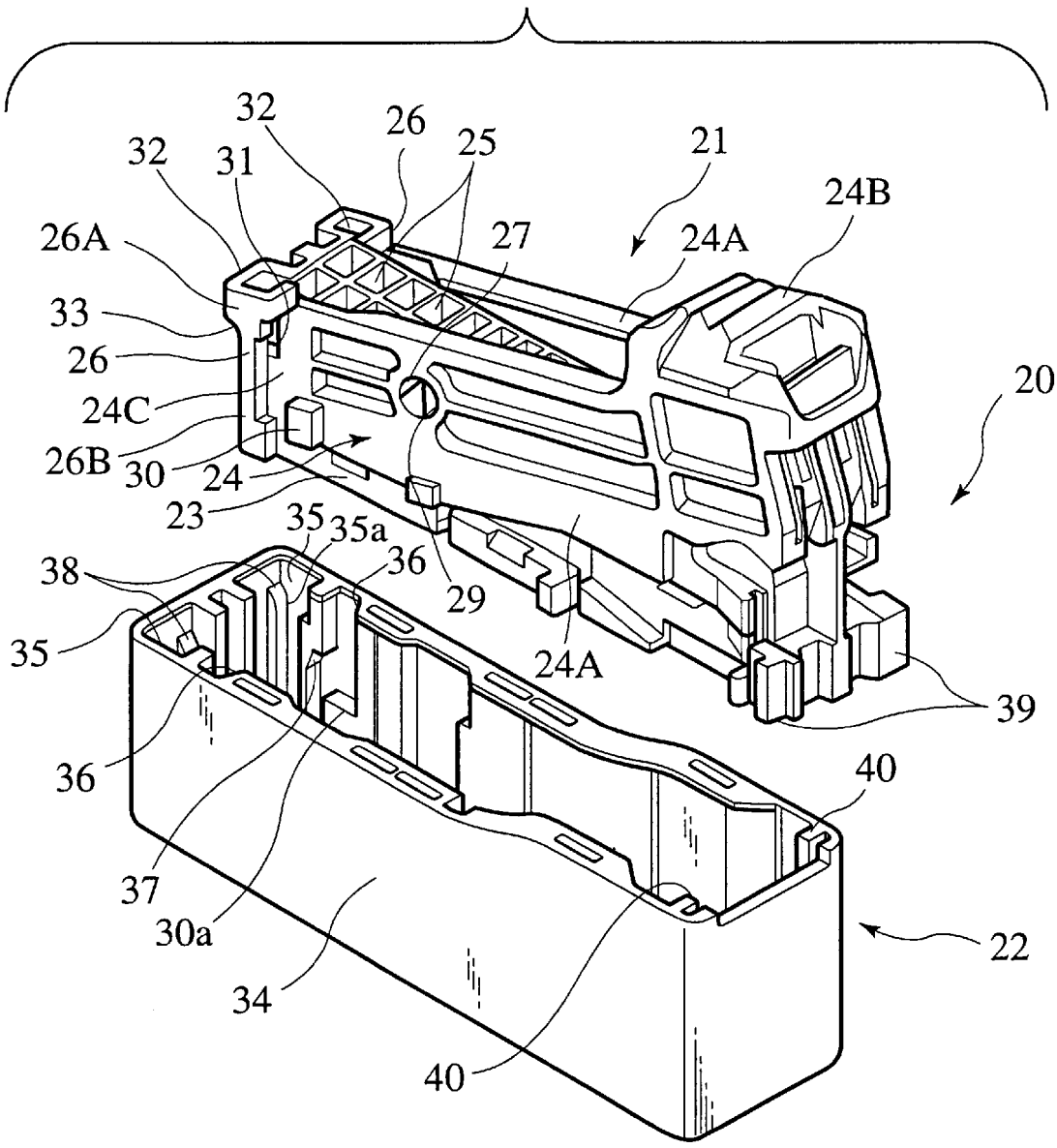
FIG. 1 is a perspective view a lever-actuated connector according to an embodiment of the present invention.

FIG. 1 is a perspective view of a lever-actuated connector 20 according to an embodiment of the present invention. As shown in FIG. 1, the lever-actuated connector 20 comprises a male connector 21, and a mating connector comprised of a resin-molded female connector (housing) 22. It should be noted that the connector 21 may preferably be a female type, and the mating connector 22 may then be a male type.

The male connector 21 is provided as a combination of a connector body 23 in the form of a resin-molded male connector housing and a resin-molded lever 24 configured to be pivoted on the connector body 23. The connector body 23 has a plurality of terminal accommodation chambers 25 passing therethrough in a mating (or up/down) direction. Inside the terminal accommodation chambers 25 are disposed metallic female terminals (not shown) to mate with metallic male terminals (not shown) inserted in the female connector 22 from the bottom. The female terminals are connected to insulated electric wires (not shown) to lead out from openings at the top of the terminal accommodation chambers 25.

Lever-arm-holding ribs 26 protrude laterally and outwardly on both side surfaces at one end of the connector body 23, with an even height to the connector body 23 in the mating direction. Lateral bosses 27 protrude from both sides of the connector body 23 at front locations thereon. Pivot holes 29 are formed in front parts of lever walls 24A opposing each other as left and right arms of the lever 24, and are fitted on the bosses 27, so that an entirety of the lever 24 is supported to be rotatable thereabout.

The lever 24 is made by the left and right lever walls 24A, and an operation part 24B as a shoulder linking the lever walls 24A at upper parts of their rear ends. At a front end of each lever wall 24A is formed an insertion protrusion 24C, which is inserted into a slot 31 (or recess) formed in corresponding rib 26. Between the insertion protrusion 24C and the pivot hole 29 on the outside of corresponding lever wall 24A, there is formed a substantially parallelepiped engaging protrusion 30 for engagement with a later-described engageable part (37) of the female connector 22 to provide a fulcrum for the lever 24 to swing, when serving to push the female connector 22 upwards or to bring the male connector 21 downwards. As shown in FIG. 1, the engaging protrusion 30 is located near the front end of lever wall 24A, but may preferably be located near the pivot hole 29 or in a central part therebetween.

The lever insertion slot 31 of each rib 26 is elongated in the mating direction so that the protrusion 24C at the front end of lever wall 24A is loose fitted. An upper linking part 26A (or top side) of the rib 26 interconnects inner and outer lateral side walls of the slot 31. The inner lateral side of the slot 31 is flush with the outside of the lever wall 24A. A lower linking part 26B (or bottom side) of the rib 26 interconnects the inner and outer lateral sides of the slot 31. The upper rib linking part 26A is bulged relative to the lower rib linking part 26B. A through hole 32 extending in the mating direction is provided through the upper rib linking part 26A, directly connecting the slot 31 with upside of the linking part 26A. The through hole 32 is substantially the same as the slot 31 in cross-sectional shape, while the former is somewhat greater than the latter in cross-sectional dimensions. The through hole 32 serves as an opening for upward removal of a die or core for the lever insertion slot 31 (and the hole 32) in the process of molding the connector body 23.

An inclined (or inwardly curved) surface 33 is formed at a front side of the upper rib linking part 26A, i.e. outside in a longitudinal direction of the connector body 23. When the connector body 23 is inserted into and fitted with the female connector 22, the inclined surface 33 engages a corresponding inclined wall surface 38 in the female connector 22, thereby functioning to correct a tilted fitting of the connector body 23 (i.e. a fitting state in which the connector body 23 is inserted deeper into the female connector 22 at the front end, where the rib 26 that holds the protrusion 24C of the lever wall 24A is guided in the mating direction, than at the rear end).

The female connector 22 has a hood 34, open at the top, into which the male connector 21 mates together with the lever 24. Inside one end of the hood 34 are formed a pair of vertical guide grooves 35 for guiding the lateral bosses 27 in the mating direction. The guide grooves 35 are each formed with a rail-like raised part 35*a*, which has at the top an inclined wall surface 38 to abut on the inclined surface 33 of corresponding upper rib linking part 26A.

Figure 2:
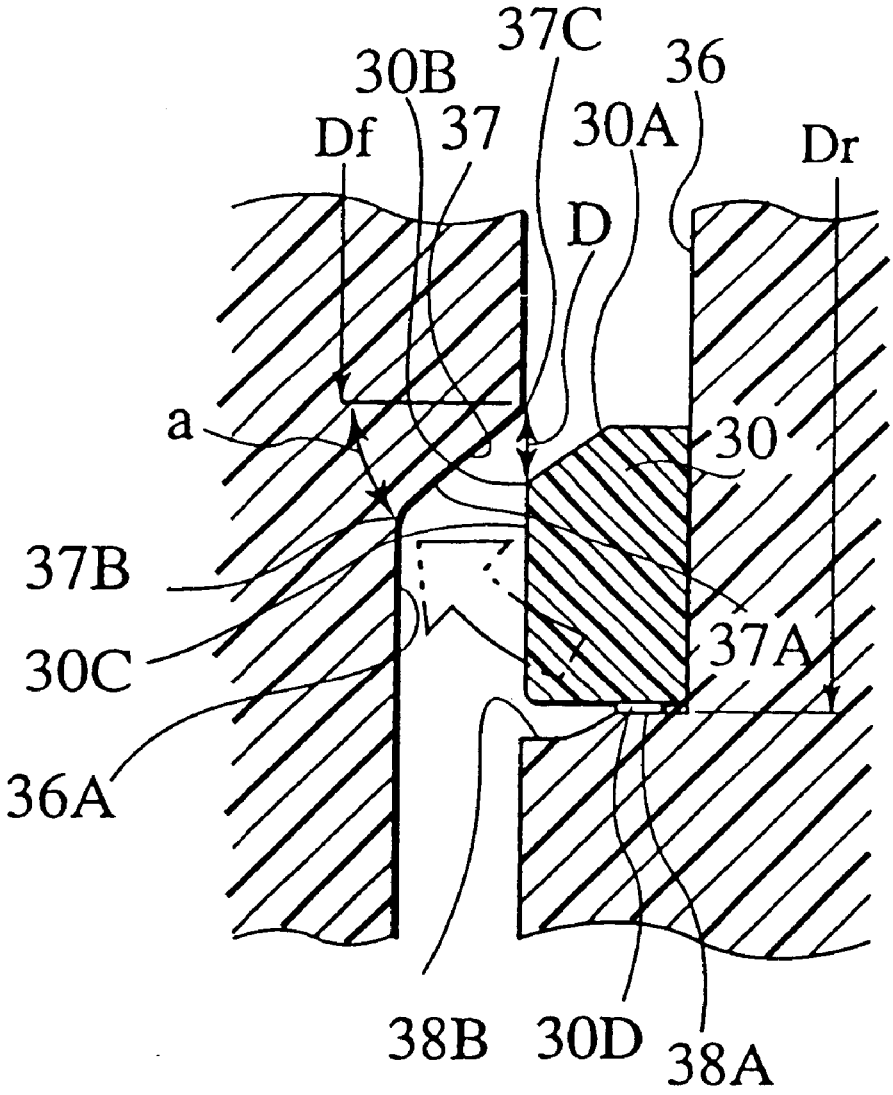
FIG. 2 is a cross-sectional view of an essential portion of the lever-actuated connector of FIG. 1.

The hood 34 has, inside front parts of the left and right side walls, a pair of left and right insertion grooves 36 formed therein for insertion of the engaging protrusions 30 provided outside the left and right lever walls 24A. In a front side of each insertion groove 36, at a specified depth Df (FIG. 2) from the top, there is formed an inclined engagement step 37 to be engaged with a later-described upper front corner (or edge) portion of corresponding engaging protrusion 30 when the lever 24 is rotated, to thereby provide the fulcrum for the lever 24 to apparently swing thereabout. As shown in FIG. 1 and FIG. 2, on a rear side of each insertion groove 36, at a specified greater depth Dr from the top than the above-noted depth Df (such that Dr−Df>height of protrusion 30), there is formed a right-angled step called contacting part 30*a* that makes contact with the engaging protrusion 30 inserted in the insertion groove 36.

There will be detailed below the engaging protrusion 30 provided on each side wall 24A of the lever 24 mounted astride the male connector 21 and the engagement step 37 formed in each side wall of the hood 34 of the female connector 22.

The contacting part 30*a* formed at the specified depth Df from the top of the insertion groove 36 is constituted as a connected combination of: a flat contacting rear surface 38A that contacts a bottom side (or a rough molded lower surface 30D in some case) of the engaging protrusion 30 when the male connector 21 and the lever walls 24A are inserted into the hood 34; and a curved or inclined front surface 38B which is recessed to extend alongside a rotation path of the engaging protrusion 30. In other words, the inclined surface 38B is configured round or frustum to avoid undesirable interference with loci that the engaging protrusion 30 describes when the lever wall 24A set in its inserted position is rotated, as illustrated by an arrow of two-dotted lines in FIG. 2, about the pivotal boss 27 of the male connector 21.

The upper front corner (or edge) of the engaging protrusion 30 is molded in the form of a tapered surface 30A, which intersects a front side surface 30C of the protrusion 30, defining therebetween a lower edge 30B of the tapered surface 30A (or an upper edge of the front side surface 30C), as a corner part 30B of an obtuse angle.

When the engaging protrusion 30 is vertically inserted to the end, where it is seated on the rear contacting surface 38A of the contacting part 30*a* (the rear side step) of the insertion groove 36, the inclined engagement step 37 confronts or opposes the tapered surface 30A of the engaging protrusion 30, at a spaced distance. The engagement step 37 is inclined from the insertion direction of the connector 21, and declined at an angle "a" from a widthwise direction of the insertion groove 36 or a longitudinal direction of the hood 34. When each lever wall 24A and the engaging protrusion 30 thereon are rotated clockwise (in FIGS. 1 and 3) about the pivotal boss 27 with pressures acting on the operation part 24B, the tapered surface 30A of the engaging protrusion 30 is brought into engagement with an inclined surface 37A, so that a surface region including the lower edge 30B and connected regions of the tapered surface 30A and/or the front side surface 30C is brought into substantially conformal contact with a lower corner part of the engagement step 37 (that is, a corresponding surface region including a lower edge 37B of the inclined surface 37A and connected regions of the inclined surface 37A and/or a lower front side 36A of the insertion groove 36), thus achieving an ensured operative engagement therebetween to provide a fulcrum for the lever wall 24A to clockwise swing thereabout, driving the pivotal projection 27 and the connector 21 downward, while rotating about the pivotal boss 27 to drive the engagement step 37 and the mating connector 22 upwards. For effective engagement, when the engaging protrusion 30 is inserted to the end, an upper edge 37C of the inclined surface 37A of the engagement step 37 and the lower edge 30B of the tapered surface 30A of the engaging protrusion 30 are spaced from each other in the mating direction by a distance D which ranges between "sin a" of a width of the tapered surface 30A and that of a width of the inclined surface 37A.

The distance D is determined so as to avoid an undesirable tilting of the connector body 23 that otherwise might occur with respect to the hood 34 due to a discrepancy in longitudinal dimensions of the connector body 23 and the hood 34. In this embodiment, as shown in FIG. 2, an additional measure is provided such that the angle "a" formed between the inclined surface 37A forming the engagement step 37 and a perpendicular direction to the mating direction is 45 degrees or smaller.

In the embodiment shown in FIG. 1, for an ensure mating between the connectors 21 and 22, additional protrusions 39 are provided on a bottom part at the rear end of the connector body 23, and corresponding grooves 40 for guiding the protrusions 39 are formed on both inner walls at the rear end of the hood 34.

The action and operation of the lever-actuated connector 20 according to this embodiment are as follows.

First, the connector 21 and mating connector 22 in the condition shown in FIG. 1 are mated by insertion of the connector body 23 into the hood 34. This does not require lever operation, and can be achieved by simply pressing the connector 21 and lever 24 into the hood 34. As this is done, the lower rib linking parts 26B are inserted into the guide grooves 35 formed in the inner walls of the hood 34. With this action, the engaging protrusions 30 are inserted into the insertion grooves 36 in the inner walls of the hood 34, and the rear protrusions 39 to be guided are inserted into the guide grooves 40 in the inner walls of the hood 34. In this condition, the bottom of each engaging protrusion 30 makes contact with the contacting surface 38A of the contacting part 30*a,* and is positioned for engagement with the engagement step 37.

Figure 3:
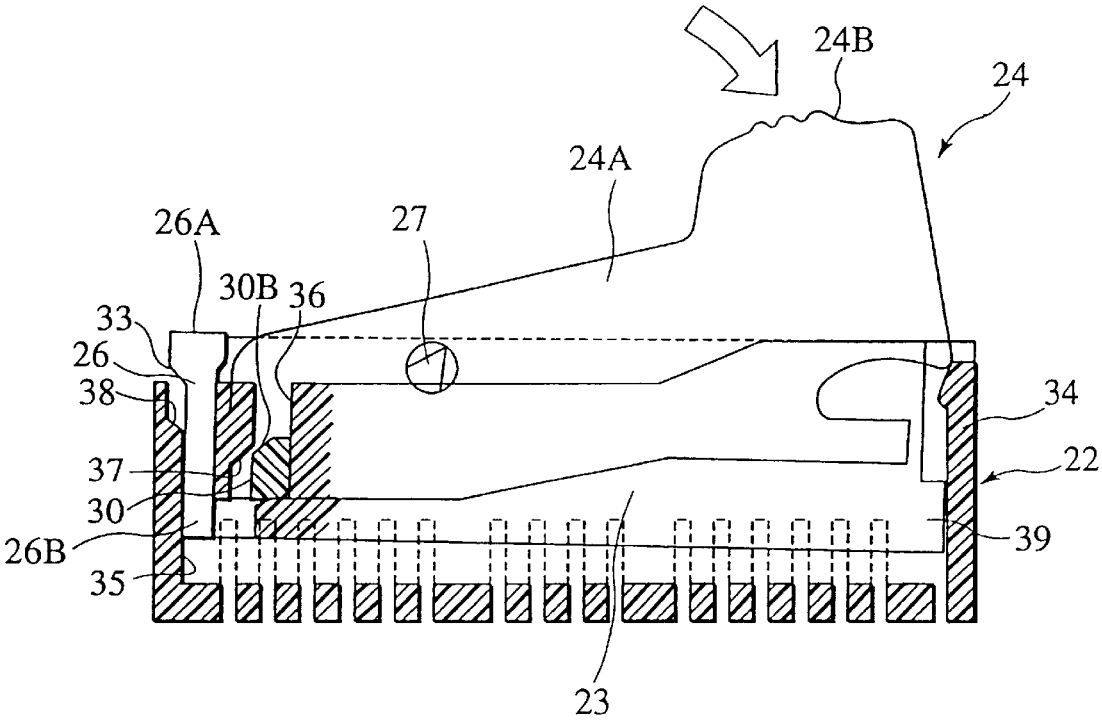
FIG. 3 is a cross-sectional view of the lever-actuated connector of FIG. 1 in a half-mated condition.

Next, with a rotation of the lever 24 in the direction of the arrow (clockwise as shown in the figure), the lever wall 24A at each side pivots about the boss 27 as the center of rotation, the engaging protrusion 30 engagies with the engagement step 37 formed on the inner wall of the hood 34. With further rotation of the lever 24, the connector body 23 is pushed into the hood 34 by a swing action of the lever wall 24A about the fulcrum provided between the engagement step 37 and the protrusion 30 engaging therewith. FIG. 3 shows a condition in which the connector body 23 is tilted with respect to the hood 34, and the rear end of the connector body 23 on which the protrusions 39 to be guided are formed is inserted deeper than the front end.

In this embodiment, in addition to the distance D shown in FIG. 2 being established by considering whether tilting of the connector body 23 occurs with respect to the hood 34 because of the discrepancy in lengths of the connector body 23 and the hood 34, by establishing this so that the angle "a" formed between the inclined surface forming the engagement step 37 and a direction perpendicular to the mating direction is 45 degrees or smaller (that is, 45 degrees or greater with respect to the mating direction), the lower edge 30B of the tapered surface 30A of the engaging protrusion 30 comes into reliable contact with the engagement step 37, thereby acting as a fulcrum for the lever 24 to swing.

Figure 4:
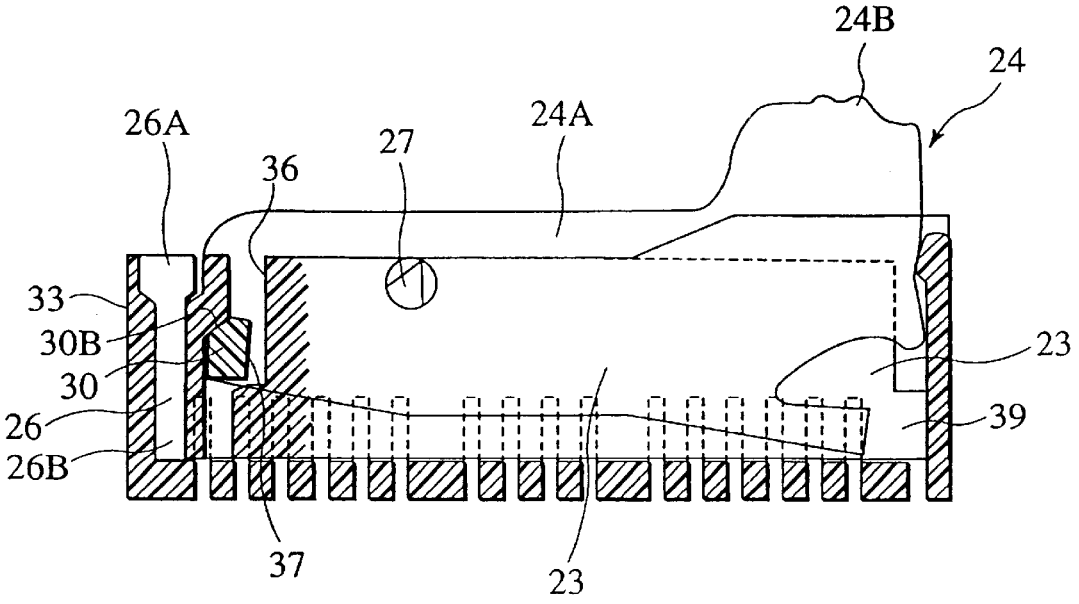
FIG. 4 is a cross-sectional view of the lever-actuated connector of FIG. 1 in a mated condition.
Figure 5:
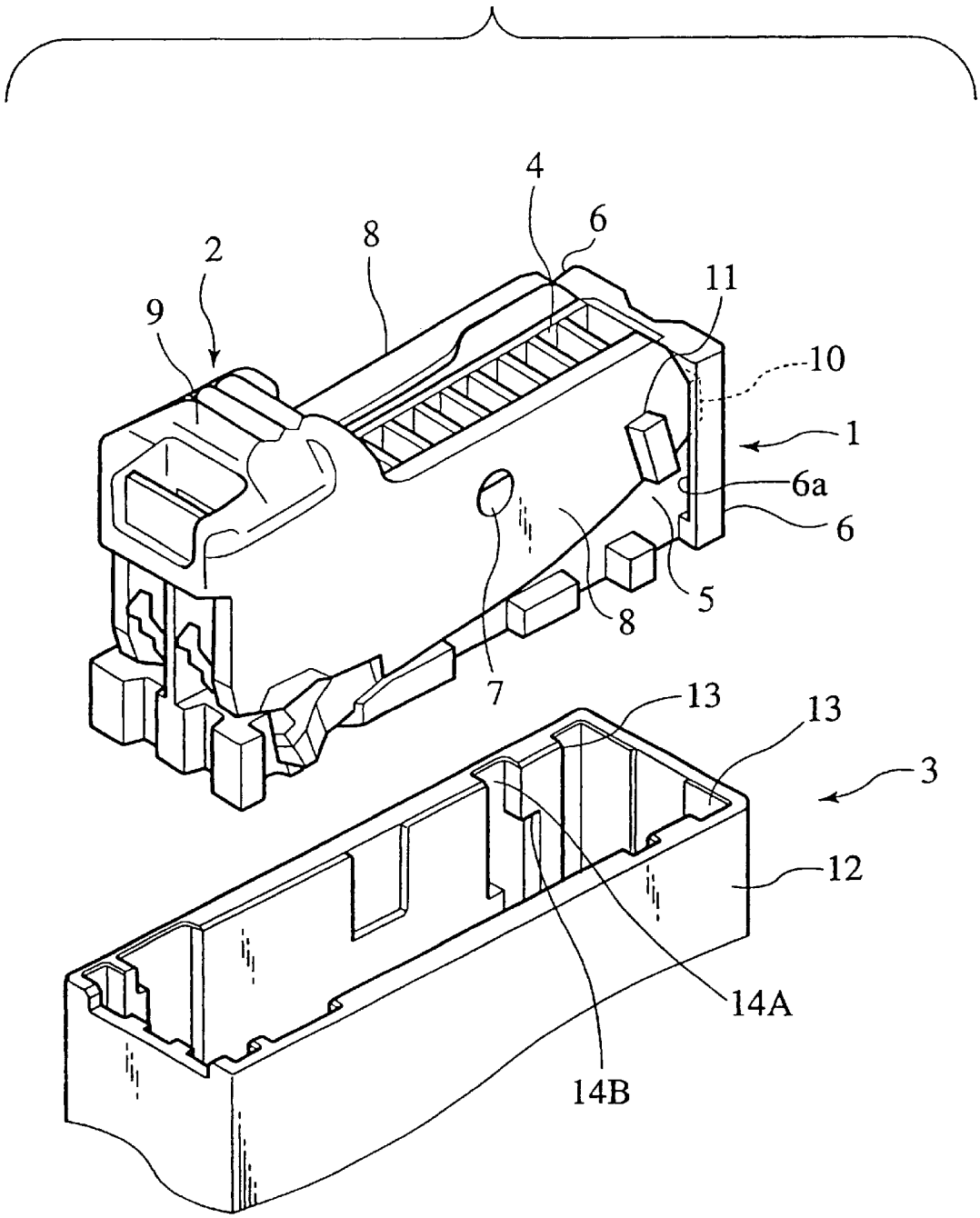
FIG. 5 is a perspective view of a conventional lever-actuated connector.
Figure 6:
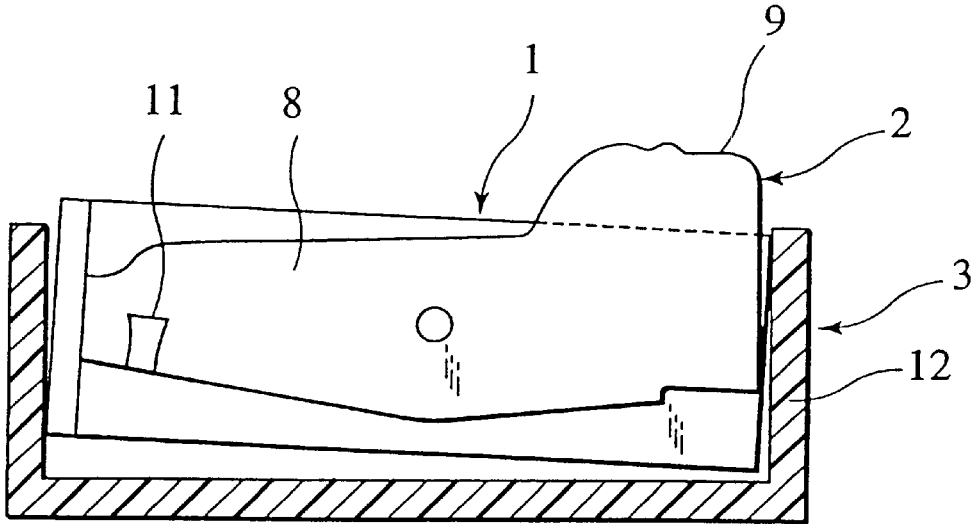
FIG. 6 is a cross-sectional view of the lever-actuated connector of FIG. 5 showing a tilting state.
Figure 7:
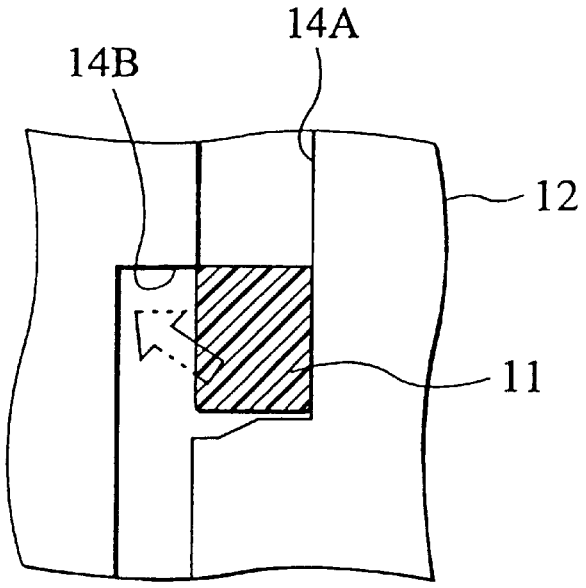
PRIOR ART FIG.7
FIG. 7 is a cross-sectional view of an essential portion of the lever-actuated connector of FIG. 5.

Thus, with rotation of the lever 24, as shown in FIG. 4 the inclined surface 33 of the upper rib linking part 26A of the lever-arm-holding rib 26 comes into contact with the inclined wall surface 38 of the raised part 35*a* on inside of the hood 34, thereby preventing tilted insertion of the connector body 23. With the connector body 23 mated to the hood 34 in a tilted condition, there occurs interference between the connector body 23 and the hood 34, thereby increasing the operating force of the lever 24. With this embodiment of the present invention, however, in addition to reliable contact between the engaging protrusion 30 and the engagement step 37, with the contacting of the inclined surface 33 with the inclined wall surface 38, it is possible with an easy lever operation to maintain a proper mating attitude of the connector body 23 when mating the connectors reliably together.

In a lever-actuated connector 20 configured as described above, because the upper rib linking parts 26A of the ribs 26 are formed to be thicker than the lower rib linking parts 26B, with a slot-forming die part 43 removed, it is possible to form the through hole 32 with the same shape and dimensions as the lever insertion slot 31, to communicate with the slot 31. This eliminates the need for a sliding die to form the lever insertion slot 31, thereby enabling manufacturing of a connector 23 at a low cost. By forming an inclining surface on one side surface of the upper rib linking part 26A of the rib 26, with a tilt in the connector body 23 with respect to the hood 34 on the connector 22 side, it is possible to correct the attitude of the tilted connector body 23. It is therefore possible to prevent interference between the connector body 23 and the hood 34 and, as a result, to enable a reduction in the operating force of the lever 24, thereby enabling smooth insertion and mating of the connector body 23 into the hood 34.

The foregoing has been a description of the present invention using exemplary embodiments, and it will be readily understood that these embodiments do not restrict the present invention, which can take on other various forms within the scope and spirit thereof.

For example, while the foregoing description was for an embodiment (FIG. 2) in which the lower edge 30B of the tapered surface 30A of the engaging protrusion 30 is established so the angle formed between the tapered surface 30A and the front side surface 30C is an obtuse angle, so that this is a contact angle of the inclined surface 37A with the lower edge 30B. It is alternately possible to make this part a curved (rounded) surface. Having done this, it is possible for the curved surface to slide along the engagement step 37, thereby facilitating the movement of the engaging protrusion 30 to a proper position to provide a fulcrum.

As a feature of the embodiment, there is disclosed a lever-actuated connector having a first connector, an intermediate part of a lever being pivotally supported on a side wall of a body thereof and a second connector with a hood accommodating the first connector, wherein an engaging protrusion provided on one end of the side wall of the lever and an insertion groove are provided on an inner wall of the hood, into which the engaging protrusion is inserted in the direction of mating between the connectors. A part engageable with the protrusion contact part of the engaging protrusion is formed at the inner rear part of the insertion groove, so that with insertion of the first connector into the second connection and a rotating operation of the lever, the lever inserts the connector body into the hood, with the engagement part between the engagement protrusion and the engageable part as a pivot, pushing it so that the first connector and the second connector are mated together. A feature of this lever-actuated connector is that the engageable part is an inclined surface that is inclined with respect to a side wall of the protrusion insertion groove and that crosses the path of rotation of the engaging protrusion with the rotation of the lever. An engaging protrusion of the lever pivotally supported by the first connector is inserted into the insertion groove formed in the inner wall of the hood of the second connector, movement being possible up until position at which the engageable part is formed. With rotation of the lever, the protrusion contact part of the engaging protrusion inserted to a prescribed depth into the insertion groove swings and makes contact with the inclined surface of the engageable part, and in doing so acts as a pivot point. With an inclined engageable part, the protrusion contact part of the engaging protrusion is permitted to slide, enabling movement thereof to an optimal position, thereby enabling reliable engagement. The inclined surface is established so that it crosses the path of rotation of the engaging protrusion with rotation of the lever, thereby reliably engaging with the engaging protrusion. This prevents missed engagement when the lever is operated.

As another feature of the embodiment, the protrusion contact part of the engagement protrusion making contact with the inclined surface is established so that, with the lever at the start of its swing, the protrusion contact part is positioned a prescribed distance in the insertion direction of the insertion groove with respect to the boundary part between the inclined surface and the protrusion insertion groove. The protrusion contact part is positioned in the insertion groove mating direction (insertion direction) at a prescribed distance from the boundary part between the protrusion contact part and the inclined surface, so that even if there is dimensional error between the hood and the first connector that causes tilting of the first connector within the hood, the engaging protrusion is reliably brought into contact with the inclined surface.

As another feature of the embodiment, the inclined surface makes an angle of at least 45 degrees with respect to the mating direction between connectors. By setting the angle of the inclined surface serving as the engaged part to at least 45 degrees with respect to the mating direction, sliding of the protrusion engaging part of the engaging protrusion along the inclined surface is facilitated, thereby enabling the establishment of a proper pivot point.

As another feature of the embodiment, the protrusion engaging part is a corner part at which the wall surfaces of the engagement protrusion meet to form an obtuse angle. As the lever is swung, because of the obtuse angle at the corner part of the protrusion engagement part of the engagement protrusion, catching onto the inclined surface is facilitated, thereby enabling a reliable engagement between the inclined surface and the protrusion engagement part.

A fifth aspect of the present invention is a variation on the fourth aspect, wherein the corner part is a curved surface with a rounded part.

As another feature of the embodiment, by rounding the corner of the protrusion engagement part, sliding along the inclined surface is further facilitated, thereby enabling engagement between the inclined surface and the protrusion engagement part at a proper position. This action establishes a proper pivot point for lever rotation, and enables reliable, smooth lever operation.

While preferred embodiments of the present invention have been described using specific terms, such description is for illustrative purposes, and it is to be understood that changes and variations may be made without departing from the spirit or scope of the following claims.

What is claimed is:

1. A lever-actuated connector comprising:

a housing assembly comprising a first connector housing formed with a first protrusion, and a lever member pivoted on the first protrusion and formed with a second protrusion; and a second connector housing configured to be pushed in a mating direction to mate on said assembly by rotation of the lever member about the first protrusion, the second connector housing being formed with an insertion groove to receive the second protrusion to allow insertion of said assembly into the second connector housing, the insertion groove having a wall part to be engaged with the second protrusion by the rotation of the lever member to pull the second connector housing in the mating direction, the wall part being inclined relative to the mating direction.

2. A lever-actuated connector comprising:

a housing assembly comprising a first connector housing formed with a first protrusion, and a lever member pivoted on the first protrusion and formed with a second protrusion; and a second connector housing configured to be pushed in a mating direction to mate on said assembly by rotation of the lever member about the first protrusion, the second connector housing being formed with an insertion groove to receive the second protrusion to allow insertion of said assembly into the second connector housing, the insertion groove having a wall part to be engaged with the second protrusion by the rotation of the lever member to pull the second connector housing in the mating direction, the wall part being inclined relative to the mating direction, wherein the second protrusion has an engaging part engageable with the wall part, and the insertion groove is configured to have the engaging part spaced from the wall part when the lever member starts the rotation.

3. A lever-actuated connector according to claim 2, wherein the engaging part is configured to be brought into surfacial contact with the wall part.

4. A lever-actuated connector according to claim 2, wherein the engaging part has a corner part defined by a pair of neighboring surfaces of the second protrusion crossing at an obtuse angle, to contact an end corner of the wall part.

5. A lever-actuated connector according to claim 4, wherein the corner part is rounded.

6. A lever-actuated connector comprising:

a housing assembly comprising a first connector housing formed with a first protrusion, and a lever member pivoted on the first protrusion and formed with a second protrusion; and a second connector housing configured to be pushed in a mating direction to mate on said assembly by rotation of the lever member about the first protrusion, the second connector housing being formed with an insertion groove to receive the second protrusion to allow insertion of said assembly into the second connector housing, the insertion groove having a wall part to be engaged with the second protrusion by the rotation of the lever member to pull the second connector housing in the mating direction, the wall part being inclined relative to the mating direction, wherein the wall part is inclined at an angle equal to or greater than 45 degrees relative to the mating direction.

* * * * *

UNITED STATES PATENT AND TRADEMARK OFFICE

CERTIFICATE OF CORRECTION

PATENT NO. : 6,309,232 B1
DATED : October 30, 2001
INVENTOR(S) : Toshiaki Okabe and Tetsuya Yamashita It is certified that error appears in the above-identified patent and that said Letters Patent is hereby corrected as shown below:

Column 8,
Line 24, "a first protrusion" should read -- an insertion protrusion --.
Line 26, "first" should read -- insertion --.
Line 27, "a second" should read -- an engaging --.
Line 30, "first" should read -- insertion --.
Line 32, "second" should read -- engaging --.
Line 34, "a wall part" should read -- an inclined engagement step --.
Line 35, "second" should read -- engaging --.
Line 37, "wall part" should read -- inclined engagement step --.
Line 41, "a first protrusion" should read -- an insertion protrusion --.
Line 43, "first" should read -- insertion --.
Line 44, "a second" should read -- an engaging --.
Line 47, "first" should read -- insertion --.
Line 49, "second" should read -- an engaging --.
Line 51, "a wall part" should read -- an inclined engagement step --.
Line 52, "second" should read -- engaging --.
Line 54, "wall part" should read -- inclined engagement step --.
Line 56, "second" should read -- engaging --.
Line 57, "wall part" should read -- inclined engagement step --.
Line 59, "wall part" should read -- inclined engagement step --.
Line 63, "wall part" should read -- inclined engagement step --.
Line 66, "second" should read -- engaging --.
Line 67, "wall part" should read -- engagement step --.

Signed and Sealed this

Second Day of July, 2002

*Attest:*

*Attesting Officer*

JAMES E. ROGAN
*Director of the United States Patent and Trademark Office*